US006904854B1

(12) United States Patent
Chuo

(10) Patent No.: US 6,904,854 B1
(45) Date of Patent: Jun. 14, 2005

(54) TRANSVERSE LONGITUDINAL-CYLINDER SEWING MACHINE

(75) Inventor: Jui-Jung Chuo, Taipei Hsien (TW)

(73) Assignee: Shing Ray Sewing Machine Co., Ltd., Taipei Hsien (TW)

( * ) Notice: Subject to any disclaimer, the term of this patent is extended or adjusted under 35 U.S.C. 154(b) by 0 days.

(21) Appl. No.: 10/734,235

(22) Filed: Dec. 15, 2003

(51) Int. Cl.[7] ..... D05B 27/08; D05B 37/04
(52) U.S. Cl. ..... 112/313; 112/323; 112/292
(58) Field of Search ..... 83/910, 936; 112/220, 112/313, 324, 53, 54, 63, 248, 292, 255

(56) References Cited

U.S. PATENT DOCUMENTS 1,317,006 A * 9/1919 De Voe ..... 112/313
2,102,202 A * 12/1937 Ebert ..... 112/313
2,158,562 A * 5/1939 Hacklander et al. ..... 112/63
2,301,454 A * 11/1942 Rubel ..... 112/261
2,729,176 A * 1/1956 Smith ..... 112/63
3,532,065 A * 10/1970 Marforio ..... 112/292
5,005,504 A * 4/1991 Alblrecht et al. ..... 112/292

* cited by examiner

*Primary Examiner*—Ismael Izaguirre
(74) *Attorney, Agent, or Firm*—Birch, Stewart, Kolasch & Birch, LLP

(57) ABSTRACT

A transverse longitudinal-cylinder sewing machine includes an automatic thread loosening device, a tension adjustment mechanism, an automatic thread cutting bi-directional solenoid device and a differential fabric driving teeth displacement control device. The differential fabric driving teeth displacement control device consists of a primary transmission mechanism, first and second push mechanisms, a rocking mechanism, first and second adjustment mechanisms that are co-axle, and first and second fabric driving mechanisms located inside a cylinder normal to the co-axle. The axial direction of the cylinder is directed towards the operator so that the axis of the cylinder is normal to the entire transverse work station of the sewing machine.

9 Claims, 11 Drawing Sheets

TRANSVERSE LONGITUDINAL-CYLINDER SEWING MACHINE

FIELD OF THE INVENTION

The present invention relates to a transverse longitudinal-cylinder sewing machine and particularly to a sewing machine that has a cylinder axis directed towards the operator. The cylinder axis is normal to the axial direction of the entire transverse work station of the sewing machine.

BACKGROUND OF THE INVENTION

Conventional industrial high speed cylinder sewing machines generally can be divided into longitudinal-cylinder sewing machine and transverse-cylinder sewing machine. The longitudinal-cylinder sewing machine has a cylinder axis directed towards the operator; the axial direction of the transmission axle of the entire sewing machine is also the same. By contrast, the cylindrical axis of the transverse-cylinder sewing machine is transverse at the front side of the operator. The longitudinal-cylinder sewing machine is widely used for sewing cuffs, elastic wristbands, auxiliary sewing or ornamental sewing for circular articles and the like. In terms of operational convenience, the adjustment mechanisms of longitudinal-cylinder sewing machines are hindered by their sewing mechanisms at the front end of the cylinder; they are both inconvenient for operation and adjustment.

In addition, during operation, the internal mechanisms of the sewing machine need lubrication to smooth the operation of movable parts. Lubrication is usually accomplished by forming a hollow interior in the transmission shaft or some larger size component and stuffing with oil-dipped cotton strands or floss. During operation, the lubricating oil seeps through the cotton strands/floss to grease the movable parts and thus ensure smooth operation. Such a design is applicable only to larger components of a sewing machine. It is not suitable for smaller elements.

SUMMARY OF THE INVENTION

Therefore the primary object of the invention is to resolve the aforesaid disadvantages. The present invention provides various transmission mechanisms driven by the same axle. The front and rear fabric driving teeth that are normal to the co-axle are driven to move to form a transverse longitudinal-cylinder sewing machine equipped with a differential fabric driving teeth displacement control device.

Another object of the invention is to provide first and second adjustment mechanisms to adjust the deviations of a first and second push mechanism to control the relative operating displacements of the front and rear fabric driving teeth. The adjustment mechanisms are rearranged on one side of the sewing machine to enable operators and repair technicians to make adjustments easily.

Yet another objective of this invention is to provide an improved design for the lubricating oil supply for various transmission mechanisms so that the lubricating oil may flow through the mechanisms for smooth operation.

In order to achieve the foregoing objectives, the transverse longitudinal-cylinder sewing machine according to the invention includes an automatic thread loosening device, a tension adjustment mechanism, an automatic thread cutting bi-directional solenoid device and a differential fabric driving teeth displacement control device. The differential fabric driving teeth displacement control device is located in a transverse work station and includes a primary transmission mechanism, first and second push mechanisms, a rocking mechanism first and second adjustment mechanisms driven by the same axle, and first and second fabric driving mechanisms located in the cylinder normal to the co-axle. Thereby the axis of the cylinder is directed towards the operator, and the axis of the cylinder is normal to the axial direction of the entire transverse work station of the sewing machine.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
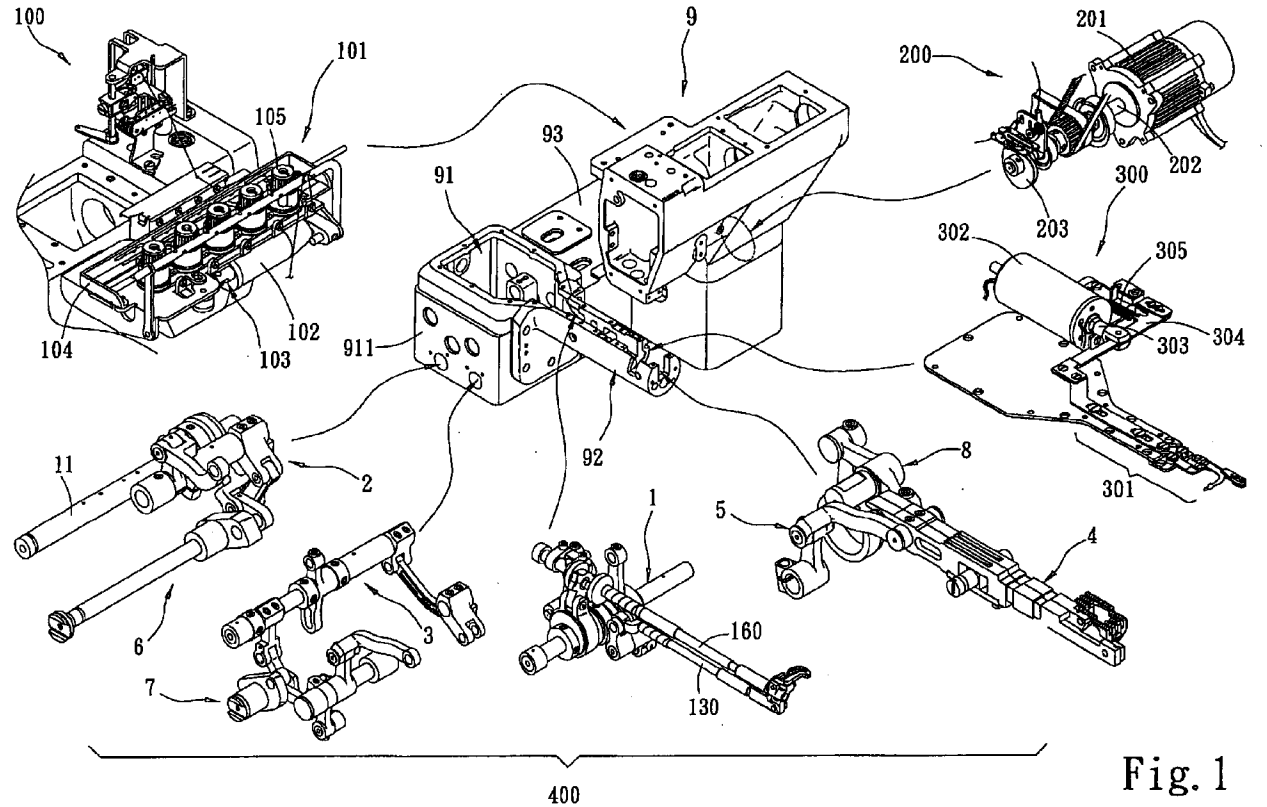
FIG. 1 is a fragmentary perspective view of a transverse longitudinal-cylinder sewing machine and various devices thereof.

Please refer to FIG. 1, the transverse longitudinal-cylinder sewing machine 9 according to the invention includes a cylinder 92 with the axis directed towards the operator. The axis of cylinder 92 is normal to the axial direction of a entire transverse work station 91 of the sewing machine. The transverse longitudinal-cylinder sewing machine 9 according to the invention includes an automatic thread loosening device 100, a tension adjustment mechanism 200, an automatic thread cutting bi-directional solenoid device 300 and a differential fabric driving teeth displacement control device 400.

The automatic thread loosening device 100 is mainly to relax the tension of yarns as desired and provides a desirable thread loosening means and location. It includes a thread connection assembly 101, a driving power supply 102 and a linking mechanism 103. The thread connection assembly 101 is located on the rear side of the top section of the sewing machine 9. The driving power supply 102 (solenoid valve) is located at the bottom of the thread connection assembly 101. The linking mechanism 103 is connected to the thread connection assembly 101 and the driving power supply 102. Its operation principle is thus: the thread connection assembly 101 has a thread clip 105 which loosens the clamps first; a thread hook 104 unfastens the thread; when the thread hook 104 is located at the first position it does not move and does not pull the yarn; when the driving power supply 102 provides power to move the thread hook 104 to a second position, the yarn is pulled. When the thread hook 104 returns to the first position, the yarn unwinds.

The tension adjustment mechanism 200 drives external bottom threads. The sewing machine 9 has a driving power source 201 which is coupled with a third shaft 202. When the operator faces the sewing machine 9, the third shaft 202 and the yarn feeding arm of the sewing machine 9 are in the same axial direction transversely located in front of the operator. The third shaft 202 is located in the main frame of the sewing machine 9 on the right side of the needle sinking position below the yarn feeding arm. The elevation of the third shaft 202 is lower than the work station of the cylinder 92 of the sewing machine 9. The third shaft 202 further is extended to one side of the sewing machine 9 to couple with a cam 203. The construction thus formed can adjust the tension of the bottom threads.

The automatic thread cutting bi-directional solenoid device 300 includes a thread cutting unit 301 specially built for the transverse longitudinal-cylinder sewing machine 9, a guiding stem 303 of the bi-directional solenoid 302 and a horizontal moving bar 304 connected to the guiding stem 303. The horizontal moving bar 304 can drive the thread cutting unit 301 to cuts the yarn. There is a micro-spring 305 to precisely maintain the horizontal moving bar 304 and the thread cutting unit 301 as the guiding stem 303 drives the horizontal moving bar 304 to its original position to prevent loosening or wobble. The bi-directional solenoid 302 drives the thread cutting unit 301 to cut the yarn. Coupled with the micro-spring 305, it can improve the unsatisfactory operation occurring in the automatic thread cutters of conventional sewing machines that drive their cutting units in a single direction.

Figure 2:
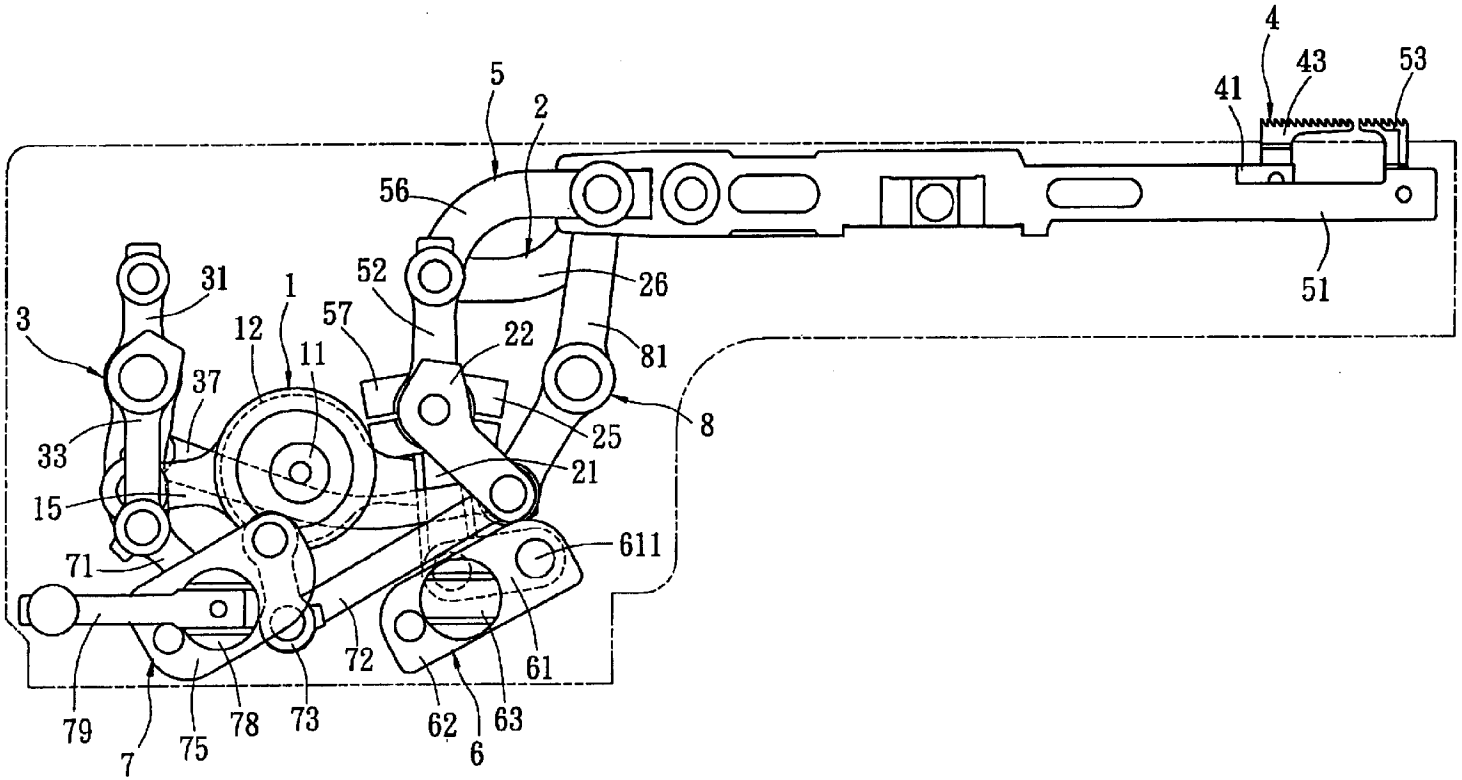
FIG. 2 is a side view of the differential fabric driving teeth displacement control device located in the transverse longitudinal-cylinder sewing machine.

Refer to FIG. 2 for the differential fabric driving teeth displacement control device located in the transverse longitudinal-cylinder sewing machine 9. The differential fabric driving teeth displacement control device 400 includes a primary transmission mechanism 1, first and second push mechanisms 2 and 3, first and second fabric driving mechanisms 4 and 5 driven by the first and second push mechanisms 2 and 3, a rocking mechanism 8 and first and second adjustment mechanisms 6 and 7 for controlling forward and backward movements of the first and second fabric driving mechanisms 4 and 5. All are driven by the same co-axle 11. The primary transmission mechanism 1, first and second push mechanisms 2 and 3, and first and second adjustment mechanisms 6 and 7 are located in the transverse work station 91 of the sewing machine 9. The first and second fabric driving mechanisms 4 and 5 are normal to the primary transmission mechanism 1 and located in the cylinder 92. When the primary transmission mechanism 1 is driven by an external motor (not shown in the drawings), the first and second push mechanisms 2 and 3, and the rocking mechanism 8 are driven. The first and second fabric driving mechanisms 4 and 5 are driven to oscillate in an ellipsoidal track to move the fabric.

Figure 3:
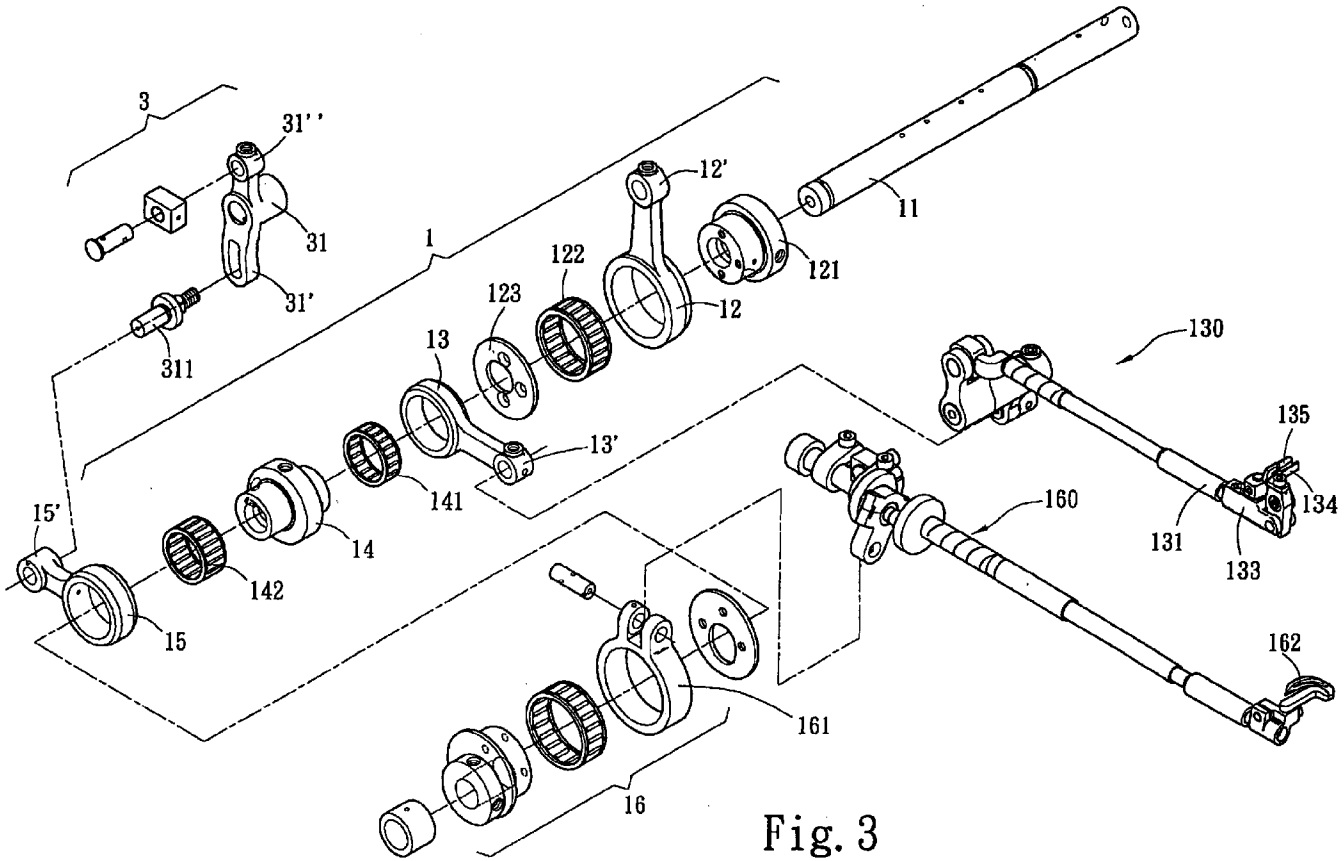
FIG. 3 is an exploded view of the primary transmission mechanism of the differential fabric driving teeth displacement control device.

Refer to FIG. 3 for the primary transmission mechanism of the differential fabric driving teeth displacement control device. The primary transmission mechanism 1 includes a co-axle 11 which is assembled, in this order, a first crank 12, a third crank 13 and a second crank 15. The first crank 12 is first coupled with an first axle sleeve 121 of a first bearing 122. The first axle sleeve 121 is fastened to one end of the co-axle 11. The third crank 13 is first coupled on one end of an second axle sleeve 14 of a second bearing 141, and then coupled to one side of the first crank 12, spaced by a washer 123. The second axle sleeve 14 has another end to couple with a third bearing 142 which couples to the second crank 15 from the outside. The second crank 15 has another side corresponding to the second axle sleeve 14 to couple with an anchor assembly 16 to enable the co-axle 11 to couple with a lower arched wire mechanism 160 and is housed in the transverse work station 91 of the sewing machine 9. The anchor assembly 16 has a crank 161 which is pivotally coupled with the lower arched wire mechanism 160. The lower arched wire mechanism 160 has an arched wire 162 at the distal end that may be moved forwards and backwards to perform complex thread picking or threading operations.

In addition, the third crank 13 has another end 13' to couple with a needle damping mechanism 130. And the second crank 15 has another end 15' located in the same direction of the first and third cranks 12 and 13 to couple with the second push mechanism 3. The needle damping mechanism 130 stabilizes the stitching needle of the sewing machine 9 without wobbling under high speed when it is moved downwards to the sewing station thereby preventing the stitching needle from breaking or skipping stitches. The needle damping mechanism 130 may be designed independently. The oscillating period of the damping needle may be adjusted separately. The needle damping mechanism 130 has a needle damper 131 which includes a movable member 133 and front and rear damping wires 134 and 135. The rear damping wire 135 is fixed to the movable member 133. The front damping wire 134 straddles the movable members 133. When the primary transmission mechanism 1 provides power, the movable member 133 moves reciprocally. The front damping wire 134 swings in the opposite direction to the aforesaid reciprocal motion and moving close to the rear damping wire 135 when the stitching needle is sinking thereby to steady the stitching needle without wobbling.

Figure 4:
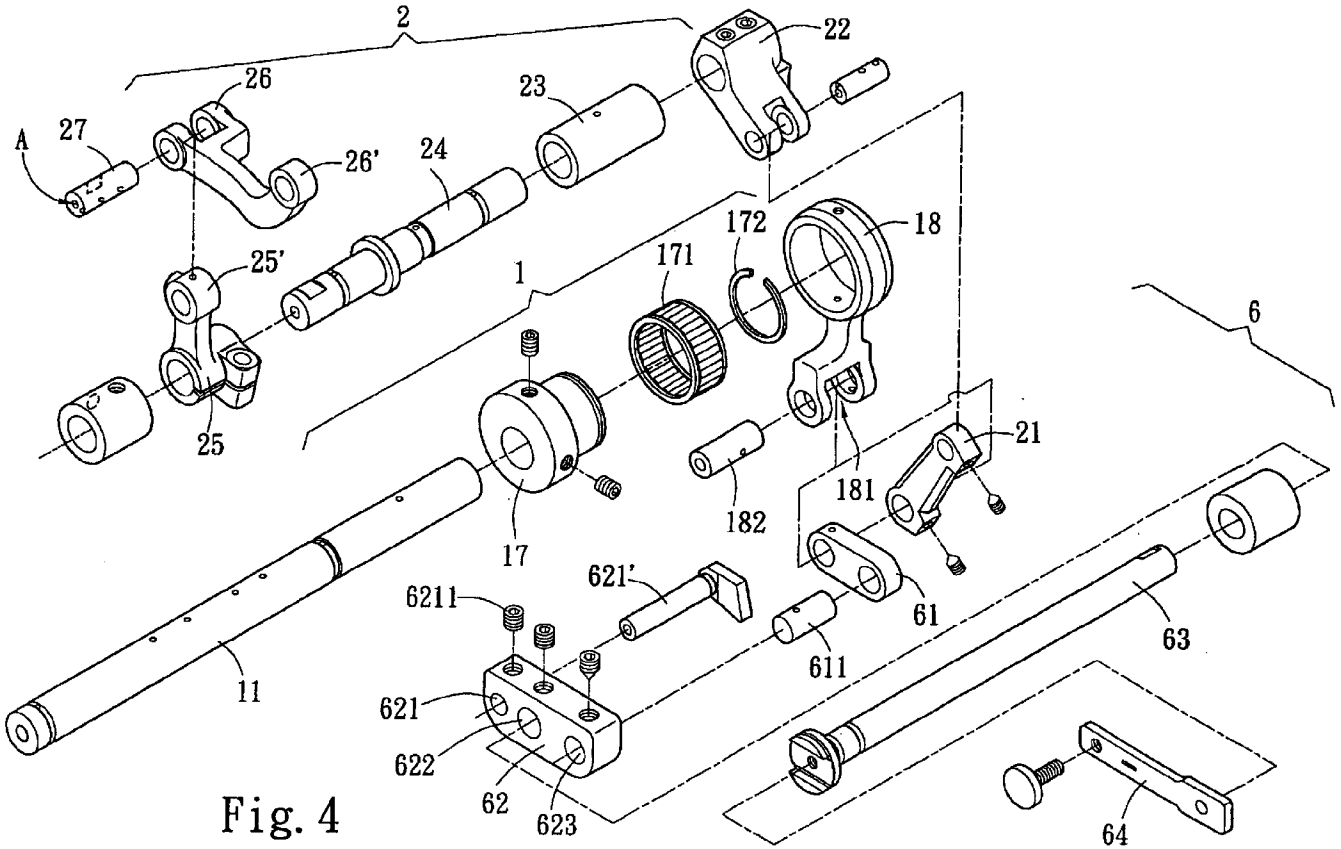
FIG. 4 is an exploded view of the primary transmission mechanism, the first push mechanism and the first adjustment mechanism of the differential fabric driving teeth displacement control device for assembling.

Refer to FIG. 4 for the primary transmission mechanism, the first push mechanism and the first adjustment mechanism of the differential fabric driving teeth displacement control device for assembling. The co-axle 11 has another end corresponding to the first crank 12 (as shown in FIG. 3) fastened to an third axle sleeve 17 which is coupled with a fourth bearing 171 and a washer ring 172. The third axle sleeve 17 is coupled with a fourth crank 18 which has a slot 181 formed on one end to pivotally couple with two linkage arms 21 and 61 through a first shaft 182. The linking arms 21 and 61 connect respectively to the first push mechanism 2 and the first adjustment mechanism 6.

Figure 7:
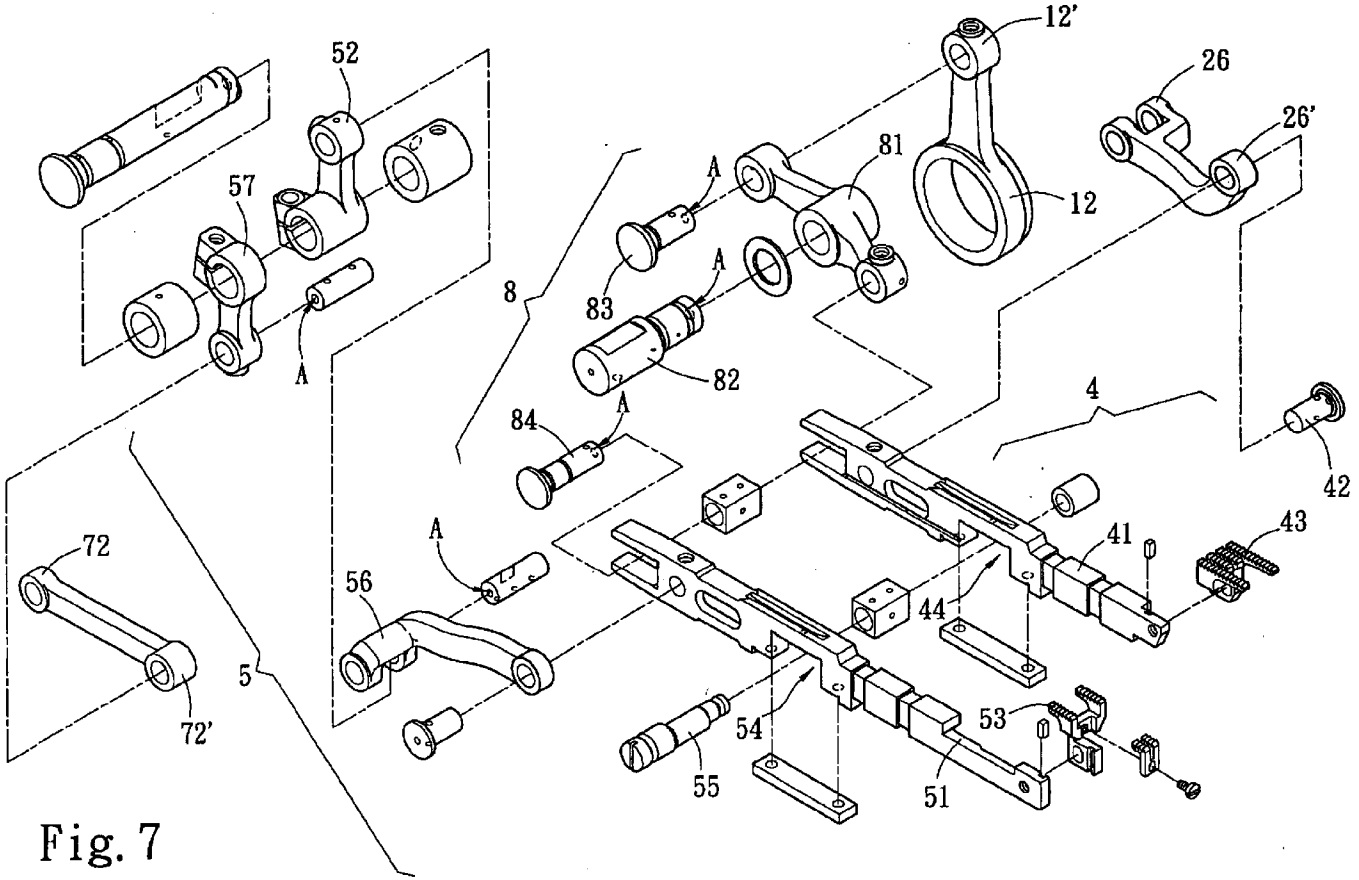
FIG. 7 is an exploded view of the second adjustment mechanism and the second fabric driving mechanism and the rocking mechanism and the first fabric driving mechanism of the differential fabric driving teeth displacement control device for assembling.

The first push mechanism 2 includes a fifth crank 22 pivotally coupled with the other end of the linking arm 21. The fifth crank 22 is coupled with a second shaft 24 through an fourth axle sleeve 23. The other end of the second shaft 24 couples with a sixth crank 25 with a second end 25' pivotally coupling to a first push arm 26 through an anchor member 27 and connecting to the first fabric driving mechanism 4 (as shown in FIG. 7).

The first adjustment mechanism 6 has a driving member 62 which has apertures 621, 622 and 623. The aperture 621 engages with the fastener 6211. The aperture 622 is coupled with a driving shaft 63 of a rocker adjustment assembly 64. The aperture 623 is pivotally coupled with the linking arm 61 through a seventh shaft 611 and connected to the primary transmission mechanism 1.

Figure 5:
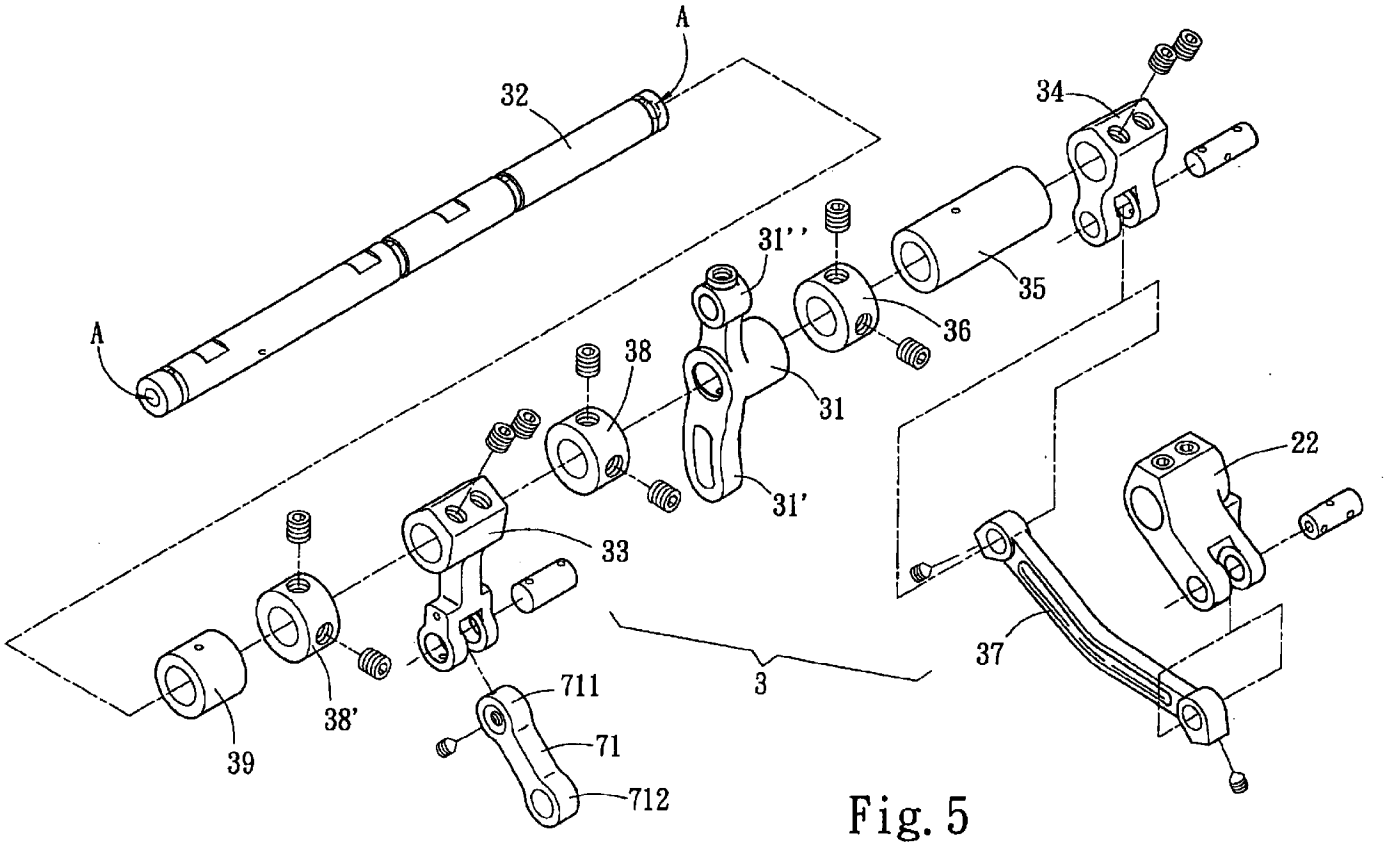
FIG. 5 is an exploded view of the second push mechanism and the first push mechanism and the second fabric driving mechanism of the differential fabric driving teeth displacement control device for assembling.

Refer to FIG. 5 for the second push mechanism, the first push mechanism and the second fabric driving mechanism of the differential fabric driving teeth displacement control device for assembling. The second crank 15 of the primary transmission mechanism 1 has another end 15' connecting to the second push mechanism 3 (as shown in FIG. 3). First, the distal end 15' of the second crank 15 is pivotally coupled with one end 31' of a seventh crank 31through a third shaft 311. The end 31' of the seventh crank 31 is located inside the sewing machine and not shown in the drawings. The seventh crank 31 is driven by an axle 32. The axle 32 located on one side of the seventh crank 31 is pivotally coupled with the fifth crank 22 of the first push mechanism 2 through an fifth axle sleeve 36, a self-lubricating bearing 35, a linking element 34 pivotally coupled with a linking arm 37. The axle 32 located inside the seventh crank 31 is coupled with a self-lubricating bearing 39 and a linking element 33 sandwiched between sixth and seventh axle sleeves 38 and 38'. The linking element 33 is connected to the second adjustment mechanism 7.

Figure 6:
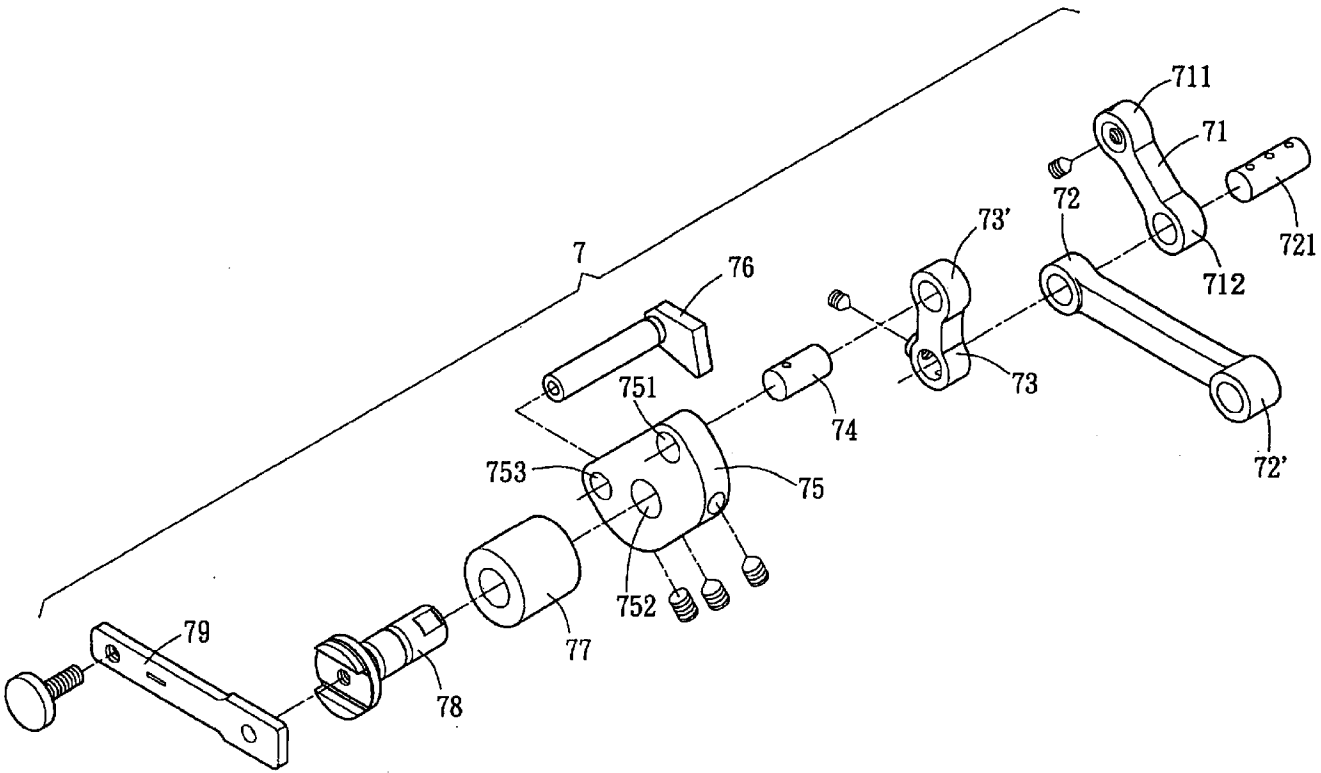
FIG. 6 is an exploded view of the second adjustment mechanism of the differential fabric driving teeth displacement control device.

Refer to FIG. 6 for the second adjustment mechanism of the differential fabric driving teeth displacement control device. The second adjustment mechanism 7 is pivotally coupled with the linking element 33 through one end 711 of the eighth crank 71 (as shown in FIG. 5). The eighth crank 71 has another end 712 pivotally coupled with a linking arm 72 and the ninth crank 73 through a fourth shaft 721. The ninth crank 73 has one end 73' connecting to a driven member 75 through a fifth shaft 74. The driven member 75 has apertures 751, 752 and 753. The aperture 751 is coupled with the fifth shaft 74. The aperture 753 receives an anchor member 76 for anchoring. The aperture 752 is coupled with a driving shaft 78 of a rocker adjustment assembly 79.

Refer to FIG. 7 for the second adjustment mechanism, the second fabric driving mechanism, the rocking mechanism and the first fabric driving mechanism of the differential fabric driving teeth displacement control device for assembling. The linking arm 72 of the second adjustment mechanism 7 has another end 72' driving the second fabric driving mechanism 5 through the tenth and eleventh cranks 57 and 52.

The first and second fabric driving mechanisms 4 and 5 includes first and second sliding arms 41 and 51 which have sliding troughs, 44 and 54 respectively at the bottom to couple with a bracing shaft 55. The first and second sliding arms 41 and 51 slide forwards and backwards in a preset space underneath the sliding troughs 44 and 54 about the bracing shaft 55 which serves as the fulcrum. The first and second sliding arms 41 and 51 have a distal end with rear fabric driving teeth 43 and front fabric driving teeth 53 located thereon. The first and second sliding arms 41 and 51 have another distal end opposite to the front and rear fabric driving teeth 53 and 43 to couple with the rocking mechanism 8 through a sixth shaft 84.

The rocking mechanism 8 is held in place by an anchor member 82. The rocking mechanism 8 has one end fastened to a rocker arm 81 mounted on the sixth shaft 84. The rocker arm 81 has another end coupled with the first crank 12 of the primary transmission mechanism 1 through a coupling member 83 (as shown in FIG. 3). The first fabric driving mechanism 4 has a distal end coupled with the other end 26' of a first push arm 26 of the first push mechanism 2 through a coupling member 42 (as shown in FIG. 4). The second fabric driving mechanism 5 has a distal end coupled with the second push mechanism 3 and the second adjustment mechanism 7 through a second push arm 56 (as shown in FIGS. 5 and 6).

Refer to FIG. 2 for the differential fabric driving teeth displacement control device located in the transverse longitudinal-cylinder sewing machine. When an external motor drives the main axle 11 (not shown in the drawings), various components of the primary transmission mechanism 1 are driven to rotate. The second crank 15 of the primary transmission mechanism 1 drives the first and second push mechanisms 2 and 3 to swing reciprocally, in the mean time, the first and second sliding arms 41 and 51 of the fabric driving mechanisms 4 and 5 slide horizontally and reciprocally in the sliding troughs 44 and 54 about the fulcrum of the bracing shaft 55. Meanwhile, the first crank 12 of the primary transmission mechanism 1 drives the rocking mechanism 8 to induce a swinging motion in the first and second sliding arms 41 and 51. Thereby through the first and second push mechanisms 2 and 3 and the rocking mechanism 8, the first and second fabric driving mechanisms 4 and 5 are driven synchronously. The first and second sliding arms 41 and 51 oscillate along an ellipsoidal track; the front and rear fabric driving teeth 53 and 43 move at a predetermined interval to drive the fabric.

Figure 8:
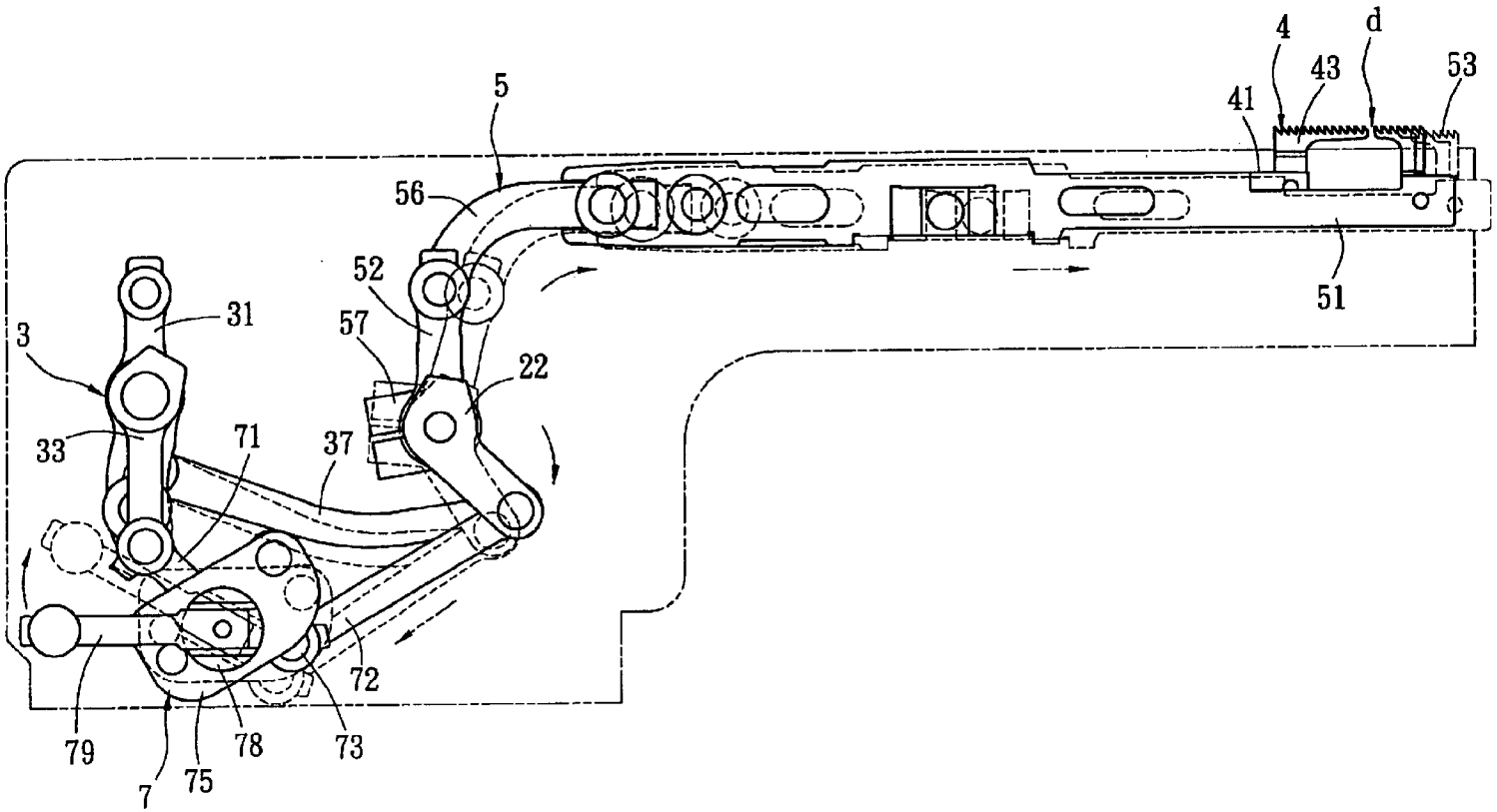
FIG. 8 is a schematic view of the first adjustment mechanism of the differential fabric driving teeth displacement control device in adjusting operations.

Refer to FIGS. 2 and 8 for the differential fabric driving teeth displacement control device located in the transverse longitudinal-cylinder sewing mechanism and the first adjustment mechanism in adjusting operation. As shown in FIG. 2, as the rocker adjustment assemblies 64 and 79 of the first and second adjustment mechanisms 6 and 7 are located outside the lateral side 91 of the transverse work station 91 of the sewing machine 9. An operator can easily adjust the deviation of the first and second push mechanisms 2 and 3 by driving the rocker adjustment assemblies 64 and 79, thereby to control the relative displacement of the front and rear fabric driving teeth 53 and 43 of the first and second fabric driving mechanisms 4 and 5. Thus, an operator can make fine tuning adjustment according to fabric nature to achieve the desired quality when sewing fabrics of different elasticity.

Refer to FIG. 8, with the first adjustment mechanism 6 stationary and the rocker adjustment assembly 79 of the second adjustment mechanism 7 adjusted, when the rocker adjustment assembly 79 is moved upwards, the driven member 75 turns clockwise, the linking arm 72 is driven downwards the fifth crank 22 is driven, and the crank 52 and second push arm 56 are turned clockwise. Finally the second push arm 56 drives the second sliding arm 51 forwards so that the relative operating interval (differential feed distance) between the front and rear fabric driving teeth 53 and 43 may increase.

By the same token, with the second adjustment mechanism 7 stationary and the first adjustment mechanism 6 adjusted, when the rocker adjustment assembly 64 is moved upwards, the driven member 61 turns clockwise, the linking arm 21 is driven; the fifth crank 22, sixth crank 25 and first push arm 26 turn clockwise at the same time; finally the first push arm 26 drives the first sliding arm 41 forwards so that the relative operation interval (differential feed distance) between the front and rear fabric driving teeth 53 and 43 may decrease.

Moreover, to meet different sewing requirements, the first and second adjustment mechanisms 6 and 7 can be adjusted at the same time to make the relative operation interval (differential feed distance) between the front and rear fabric driving teeth 53 and 43 to be maximum or minimum.

Figure 9:
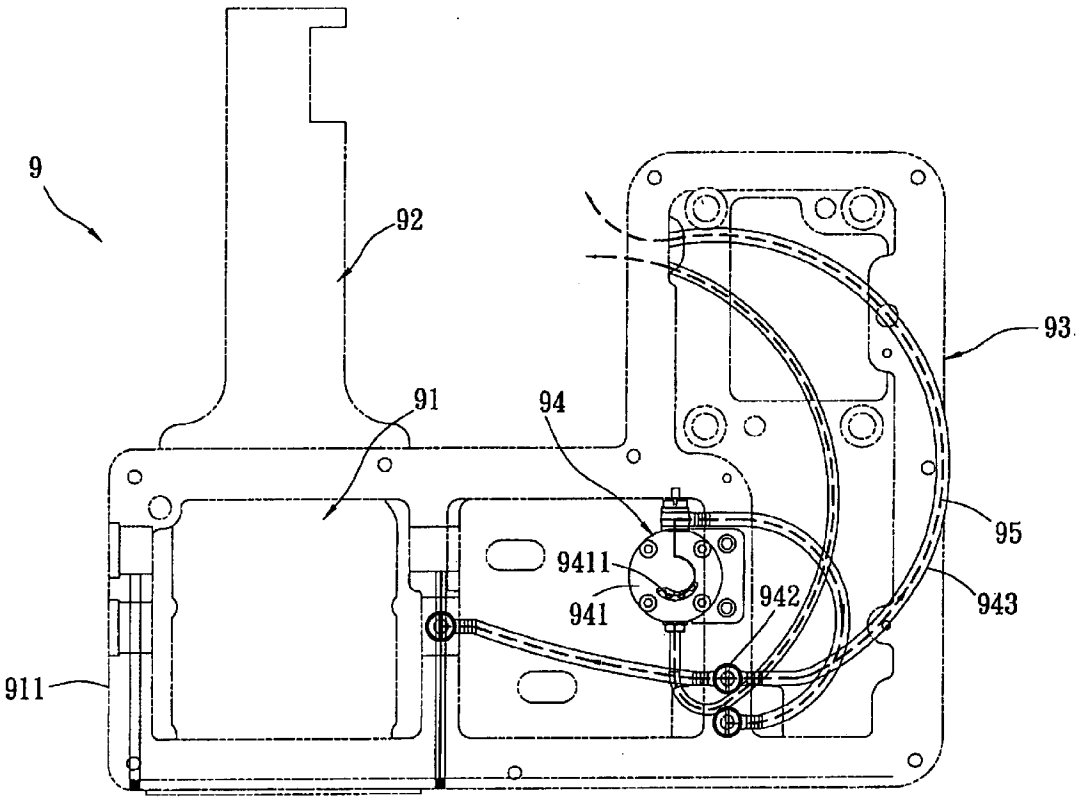
FIG. 9 is a schematic view of the lubrication system of the transverse longitudinal-cylinder sewing machine.

Refer to FIG. 9 for the lubrication system of the transverse longitudinal-cylinder sewing machine. To smooth the operation of all moving parts, reduce friction and prevent wear and tear, a comprehensive lubrication system 94 is provided in the sewing machine 9. The lubrication system 94 according to the invention is located in the main frame 93 of the sewing machine 9. It mainly includes an oil pump 941, a filter 942 and a plurality of oil ducts 943. The oil pump 941 has a lower spindle and an impeller 9411 that rotates to drive lubricating oil from an oil reservoir through the oil ducts 943 to the filter 942. Forcing the lubricating oil to the upper dock (not shown in the drawings) of the sewing machine 9 and the differential fabric driving teeth displacement control device 400 (as shown in FIG. 1).

Figure 10A:
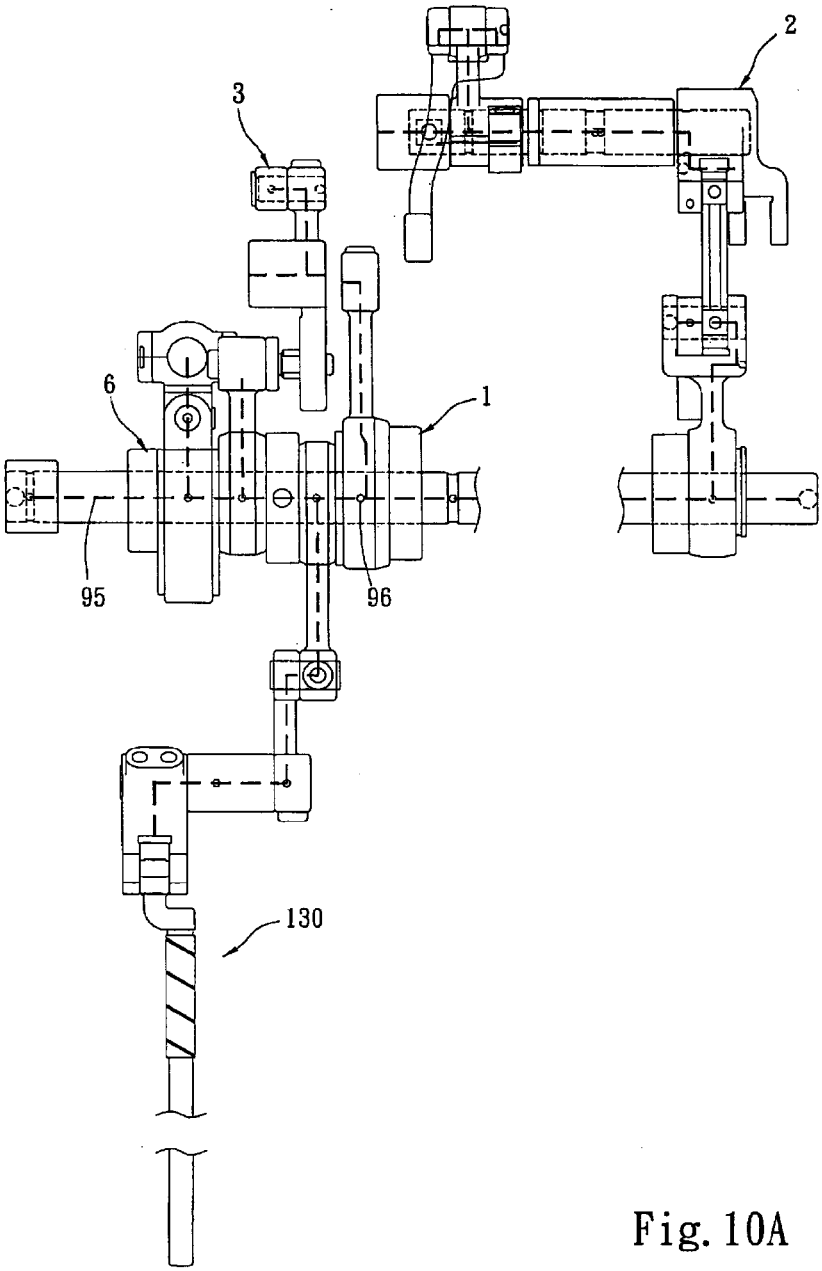
FIGS. 10A and 10B are schematic views of lubricating oil passages in various mechanisms of the transverse longitudinal-cylinder sewing machine.
Figure 10B:
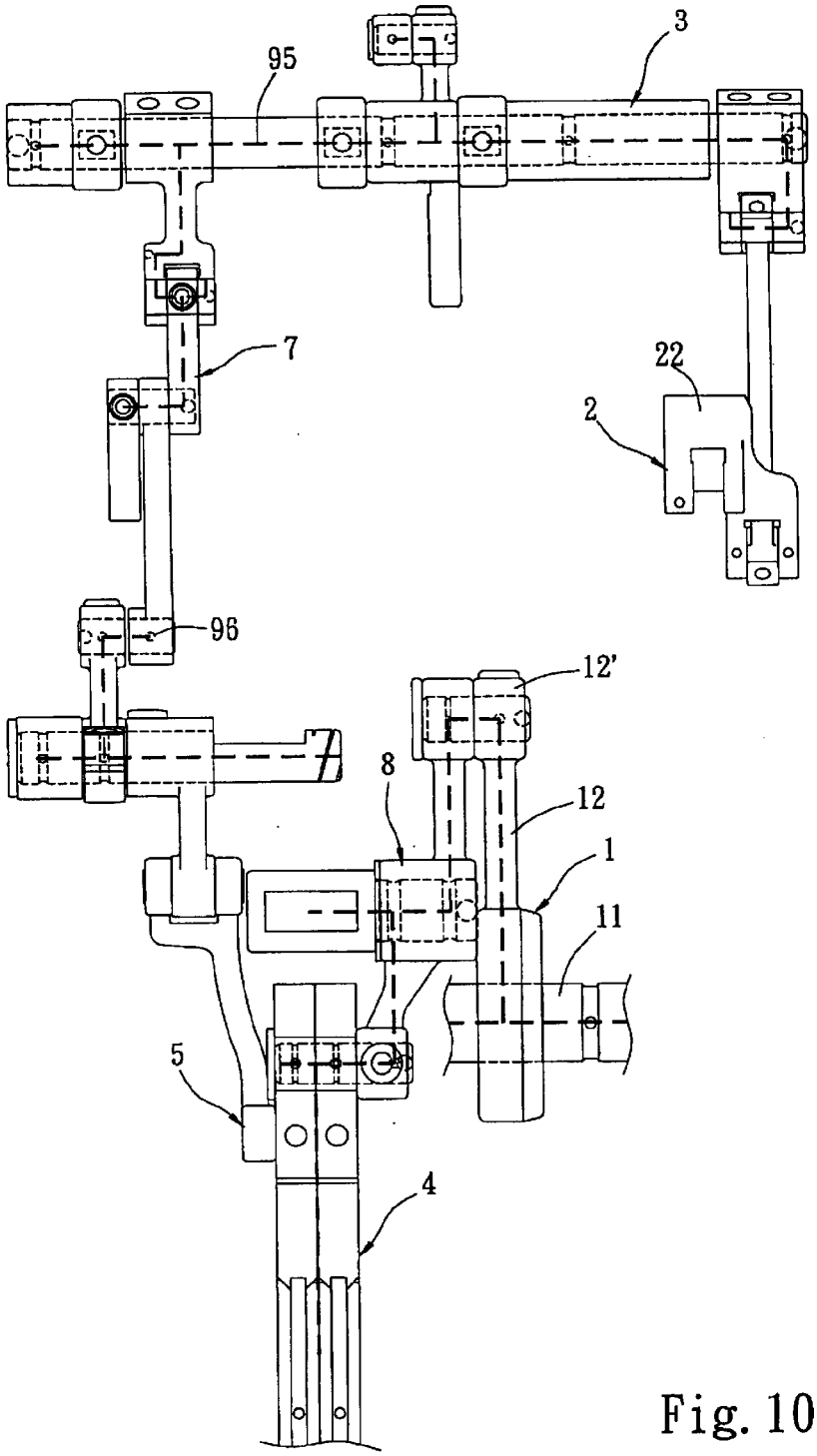

Refer to FIGS. 10A and 10B for the lubricating oil passages in various mechanisms of the transverse longitudinal-cylinder sewing machine. The primary transmission mechanism 1, first and second push mechanisms 2 and 3, first and second fabric driving mechanisms 4 and 5, and first and second adjustment mechanisms 6 and 7 of the differential fabric driving teeth displacement control device 400 have oil passages 95 (indicated by thick broken lines) and oil ports 96. After various mechanisms are assembled, the oil ports 96 communicate with one another so that the lubricating oil may flow through every element. Under high speed operation, the lubricating oil transfer's to lubricate every component. Where the oil port 96 does not correspond to another oil port 96 for connection, the oil port 96 is sealed by a sealing element A (as shown at two ends of the shaft 32 in FIG. 5). Therefore oil leakage may be prevented to achieve smooth operation of every transmission mechanism.

What is claimed is:

1. A transverse longitudinal-cylinder sewing machine, comprising:

an automatic thread loosening device;

a tension adjustment mechanism;

an automatic thread cutting bi-directional solenoid device; and a differential fabric driving teeth displacement control device which includes;

a primary transmission mechanism including a co-axle which is assembled in this order: a first crank, a second crank and a third crank, a seventh crank being coupled with a first axle sleeve of a first bearing, said first axle sleeve being fastened to one end of said co-axle, said third crank being coupled on one end of a second axle sleeve of a second bearing, then coupled to one side of said seventh crank spaced by a washer, said second axle sleeve having another end coupling with a third bearing which is coupled with said second crank from outside, said second crank having another side corresponding to said second axle sleeve to couple with an anchor assembly to allow said co-axle to couple with a lower arched wire mechanism; said co-axle, having another end corresponding to said seventh crank fastened to a third axle sleeve which is coupled with a fourth bearing and a washer ring, said third axle sleeve being coupled with a fourth crank which has a slot formed at one end to couple with a first shaft to pivotally engage with two linking arms to connect said first push mechanism and said first adjustment mechanism;

a first and a second push mechanisms driven by said primary transmission mechanism for swinging reciprocally;

a first and a second adjustment mechanisms connecting to said first and said second push mechanisms;

a rocking mechanism driven by said primary transmission mechanism; and a first and a second fabric driving mechanisms driven by said first and said second push mechanisms for reciprocal and horizontal movement, driven by said rocking mechanism for swinging up and down thereby to move oscillate along an ellipsoidal track;

wherein said first and said second fabric driving mechanisms are normal to other mechanisms and form chained movements therewith to control an operation displacement between said first and said second fabric driving mechanisms, thereby to facilitate fabric movement and adjust to deviations of said first and said second push mechanisms through said first and said second adjustment mechanisms to control the relative operating displacements therebetween.

2. The transverse longitudinal-cylinder sewing machine of claim 1, wherein said the first push mechanism includes a fifth crank which is pivotally coupled with another end of said linking arm, said fifth crank being coupled with a second shaft through a fourth axle sleeve, said second shaft having another end coupling with a sixth crank which has another end to pivotally couple with a first push arm through an anchor member and connect to said first fabric driving mechanism.

3. The transverse longitudinal-cylinder sewing machine of claim 1, wherein said first adjustment mechanism has a driven member which has apertures formed thereon, one aperture being engaged with a fastener for fastening, another aperture being coupled with a driving shaft of a rocker adjustment assembly, and yet another aperture being pivotally coupled with one of said linking arms through a seventh shaft.

4. The transverse longitudinal-cylinder sewing machine of claim 1, wherein said second crank of said primary transmission mechanism has another end connecting to said second push mechanism, the another end of said second crank being pivotally coupled with one end of said seventh crank through a third shaft, the end of said seventh crank inside the sewing machine, said seventh crank being driven by an axle, said axle located on one side of said seventh crank and being coupled with said first push mechanism through an fifth axle sleeve, a self-lubricating bearing, a linking element and a linking arm pivotally coupled to said linking element; said axle located on another side of said seventh crank being coupled with another self-lubricating bearing and a linking element sandwiched between sixth and seventh axle sleeves, said linking element being connected to said second adjustment mechanism.

5. The transverse longitudinal-cylinder sewing machine of claim 1, wherein said second adjustment mechanism is pivotally coupled with a linking element through one end of a eighth crank having another end pivotally coupled with one of said linking arms and a ninth crank through a fourth shaft, said ninth crank having one end connecting to a driven member through a fifth shaft, said driven member having apertures formed thereon, one aperture being coupled with said fifth shaft, another aperture being coupled with an anchor member for anchoring, and a final aperture being coupled with a driving shaft of a rocker adjustment assembly, said linking arm of said second adjustment mechanism having another end driving said second fabric driving mechanism through tenth and eleventh cranks.

6. The transverse longitudinal-cylinder sewing machine of claim 1, wherein said first and said second fabric driving mechanisms include first and second sliding arms which have sliding troughs at the bottom to couple with a bracing shaft which serves as a fulcrum to said first and said second sliding arms, said first and said second sliding arms having distal ends which have rear fabric driving teeth and front fabric driving teeth respectively.

7. The transverse longitudinal-cylinder sewing machine of claim 6, wherein said first and said second sliding arms have respectively another distal end opposite to the front and the rear fabric driving teeth to couple with said rocking mechanism through a sixth shaft; said rocking mechanism having one end fastening to a rocker arm mounted on said sixth shaft, said rocker arm having another end coupled with said seventh crank of said primary transmission mechanism through a coupling member.

8. The transverse longitudinal-cylinder sewing machine of claim 1, wherein said first fabric driving mechanism has a distal end coupled with a first push arm of said first push mechanism through a coupling member, and said second fabric driving mechanism has a distal end coupled with said second push mechanism and said second adjustment mechanism through a second push arm.

9. The transverse longitudinal-cylinder sewing machine of claim 1, wherein said primary transmission mechanism, said first and said second push mechanisms, said first and said second fabric driving mechanisms and said first and said second adjustment mechanisms have oil passages and oil ports that communicate with each other after assembly.

* * * * *